United States Patent [19]

Jeans

[11] Patent Number: 4,555,371

[45] Date of Patent: Nov. 26, 1985

[54] CARBONATOR FOR A BEVERAGE DISPENSER

[75] Inventor: Edward L. Jeans, Monmouth, Wales

[73] Assignee: Cadbury Schweppes, Plc, London, England

[21] Appl. No.: 393,298

[22] Filed: Jun. 29, 1982

Related U.S. Application Data

[63] Continuation-in-part of Ser. No. 140,685, Apr. 16, 1980, abandoned.

[51] Int. Cl.[4] ..... B01F 3/04

[52] U.S. Cl. ..... 261/122; 99/323.1; 141/29; 215/100 A; 215/259; 222/129.1; 261/DIG. 7

[58] Field of Search ..... 261/64 R, 122, DIG. 7; 215/1 R, 100 A, 259; 222/129.1; 141/29; 137/560, 852, 614.05; 99/295, 323.1

[56] References Cited

U.S. PATENT DOCUMENTS

| | | | |
|---|---|---|---|
| 1,885,678 | 11/1932 | Boyer | 261/DIG. 7 |
| 1,889,886 | 12/1932 | Dawson | 261/DIG. 7 |
| 2,051,933 | 8/1936 | Andvig | 261/DIG. 7 |
| 2,600,901 | 6/1952 | Meldau | 261/DIG. 7 |
| 3,195,779 | 7/1965 | Nicko | 222/129.1 X |
| 3,250,433 | 5/1966 | Christine et al. | 222/131 |
| 3,266,672 | 8/1966 | Dean | 222/129.1 |
| 3,292,527 | 12/1966 | Stasse | 99/295 |
| 3,292,822 | 12/1966 | Crowder et al. | 222/129.1 |
| 3,312,083 | 4/1967 | Scoggins et al. | 62/390 |
| 3,397,870 | 8/1968 | McCann et al. | 261/DIG. 7 |
| 3,472,425 | 10/1969 | Booth | 222/129.1 |
| 3,578,295 | 5/1971 | Hudson | 261/122 |
| 3,637,197 | 1/1972 | Hudson | 261/122 |
| 3,710,981 | 1/1973 | Arzberger et al. | 222/129.1 |
| 3,746,323 | 7/1973 | Buffington | 261/122 |
| 3,752,452 | 8/1973 | Iannelli | 261/DIG. 7 |
| 3,800,826 | 4/1974 | McCann | 137/614.05 X |
| 4,222,972 | 9/1980 | Caldwell | 261/DIG. 7 |
| 4,316,557 | 2/1982 | Benoun et al. | 222/129.1 |

*Primary Examiner*—Richard L. Chiesa
*Attorney, Agent, or Firm*—Kenyon & Kenyon

[57] ABSTRACT

A removable batch-type diluent tank for use in connecting to a rigid gas coupling in a beverage dispenser has a tank body for containing a supply of diluent having an opening and a removable cover for covering and sealing the opening. Also included is a relief valve for relieving pressure in the tank prior to removal of the cover. A quick disconnect coupling is rigidly connected to the tank and adapted for sliding connection with the rigid coupling of the dispenser, permitting the tank to be slid into the dispenser for connecting a source of pressurizing gas to the tank. Also included is a connection for conducting diluent from the tank.

24 Claims, 21 Drawing Figures

CARBONATOR FOR A BEVERAGE DISPENSER

RELATED APPLICATION

This application is a continuation-in-part of application Ser. No. 140,685 filed Apr. 16, 1980, now abandoned.

BACKGROUND OF THE INVENTION

This invention relates to carbonated beverages in general and more particularly to a carbonator particularly useful in an in-home carbonated beverage dispenser.

Consumers throughout the world consume large quantities of carbonated beverages. Typically, carbonated beverages which are consumed in the home are supplied to the consumer in either cans or bottles. Typically, cans are supplied in 12 ounce sizes and bottles in sizes up to two liters. A carbonated beverage is made up of carbonated water to which there is mixed a juice or syrup. A good tasting beverage requires good water, the proper level of carbonation and the proper proportions between the syrup and carbonated water. Thus, in the commercial production of bottles or cans of carbonated beverages the equipment used includes a carbonator for carbonating the water, a concentrate, i.e., a juice or syrup, dispenser for dispensing the concentrate in the proper quantities and mixing it with the carbonated water, and a filling device for filling the mixed beverage into the bottles. Also included is a chiller unit for chilling the water to be carbonated. Carbonation is carried out by bringing carbon dioxide and water into contact with each other in such a manner that the carbon dioxide dissolves into the water. Typically the water is over carbonated since in the step of dispensing into the bottles or cans, a certain amount is lost. Systems can be operated in which the water and syrup are mixed prior to or after carbonation.

In addition to bottled and canned carbonated beverages, carbonated beverages are also dispensed in restaurants, and at soda fountains and the like. The devices used for such dispensing are known as post mix dispensers and include the same basic elements as one finds in a carbonation plant. In other words, they include means for chilling the water, carbonating equipment for introducing carbon dioxide into the water, a juice or syrup dispenser for dispensing metered amounts of concentrate into the water and a tap for dispensing the mixture of concentrate and water into a glass or cup. Typically, mixing of the concentrate and water is carried out at the tap.

Until recently, there has been very little attention given to in-home carbonated beverage dispensers. Typical in-home beverage dispensers known in the prior art were of the type in which the concentrate and carbonated water were separately dispensed. Thus, someone making a drink would have to judge how much syrup to dispense into a given container, dispense that syrup and then add carbonated water. Obviously, a consistent beverage was not obtained. Possibly, because of difficulties in this type of device, in-home dispensers for carbonated beverages never became popular. However, the need for such dispensers should be evident. If, carbonated beverages are purchased in cans, for example, when a can is opened, its contents should be used as soon as possible, since any beverage left over will lose its carbonation. Large recloseable containers to some extent overcome this problem. However, even though these containers are recloseable, after a period of time, their contents will also lose some of their carbonation. Thus, the ability to in effect make carbonated beverages when and in the quantities needed in the home would be of great advantage. However, for an in-home dispenser to be practical, and economically feasible, it must be relatively inexpensive and easy to operate.

It is the object of the present invention to provide an improved carbonator for use in beverage dispensers, particularly in-home dispensers.

SUMMARY OF THE INVENTION

The present invention provides a particularly safe and efficient carbonator for use in a free-standing in-home beverage dispenser. The carbonator, since it is not connected to the water supply, must be periodically filled with water and includes basically a sealed vessel to which pressurized carbon dioxide is supplied through a diffuser within a body of water contained within it. The system includes a pressure vessel for the water and means for admitting carbon dioxide under pressure to the diffuser from which it bubbles through the water, any carbon dioxide not absorbed remaining in a head space above the water.

Since this container is normally pressurized, it is necessary that safety features be provided to prevent danger to the user at the time of refilling the water container. Furthermore, it is preferred that the water container be removeable for such purposes. In accordance with the present invention the carbonator contains a number of features to facilitate its removal and refilling in a safe manner. This includes a design of cover for the carbonator which is easy to use and prevents removal of the cover until pressure within the carbonator is released. This is accomplished by latching a relief valve in place as the cover is screwed on. The latch of the relief valve constitutes a stop preventing turning of the cover until pressure is released. Furthermore, a unique sealing arrangement of the cover is provided in which sealing occurs between the circumferential portions of the container and the cap so that it is not necessary that the cap be turned all the way in to insure pressure tightness.

Since normally, during operation, the carbonator is connected to a supply of carbon dioxide, means must also be provided to permit such connection to be quickly made and disconnected. Thus, the dispenser of the present invention also includes a quick release connection for the carbonator which contains appropriate valving means to shut off the carbon dioxide supply as the carbonator is removed from the dispenser, and, at the same time, the water supply from the carbonator is disconnected. Since it is necessary that when the carbonator is in place it be held in contact with the quick release connection supplying the carbon dioxide, a special design of the handle including a pin for retaining the carbonator in place is provided. The handle on the carbonator is a folding handle which when folded into place inserts a pin into a base member on which the carbonator sits, holding the carbonator in place against the connecting block containing carbon dioxide and water supply ports. When the handle is extended to remove the carbonator the pin is removed from the base member permitting the carbonator to be pulled away. In accordance with an alternate embodiment of the present invention the carbonator is vertically mounted on the quick release connection thereby insuring proper contact by means of its weight.

In another embodiment in which the carbonator is fixed to the in-home dispenser, means are provided to shut off the supply of carbon dioxide to the carbonator when the lid is to be opened in addition to the other safety features provided in the embodiment of the carbonator which is removable.

DETAILED DESCRIPTION OF THE INVENTION

The present invention will be described in detail in connection with an in-home dispensing unit particularly adapted for carbonated beverages. However, the various aspects of the present invention are also useful in other environments, such as in restaurants, soda fountains, etc. Furthermore, in addition to being useful for preparing carbonated drinks, the dispenser of the present invention can also be used for making still drinks, for example, for mixing a fruit juice concentrate with water to make a juice, and also for making hot drinks by mixing hot water with a suitable concentrate.

Figure 1:
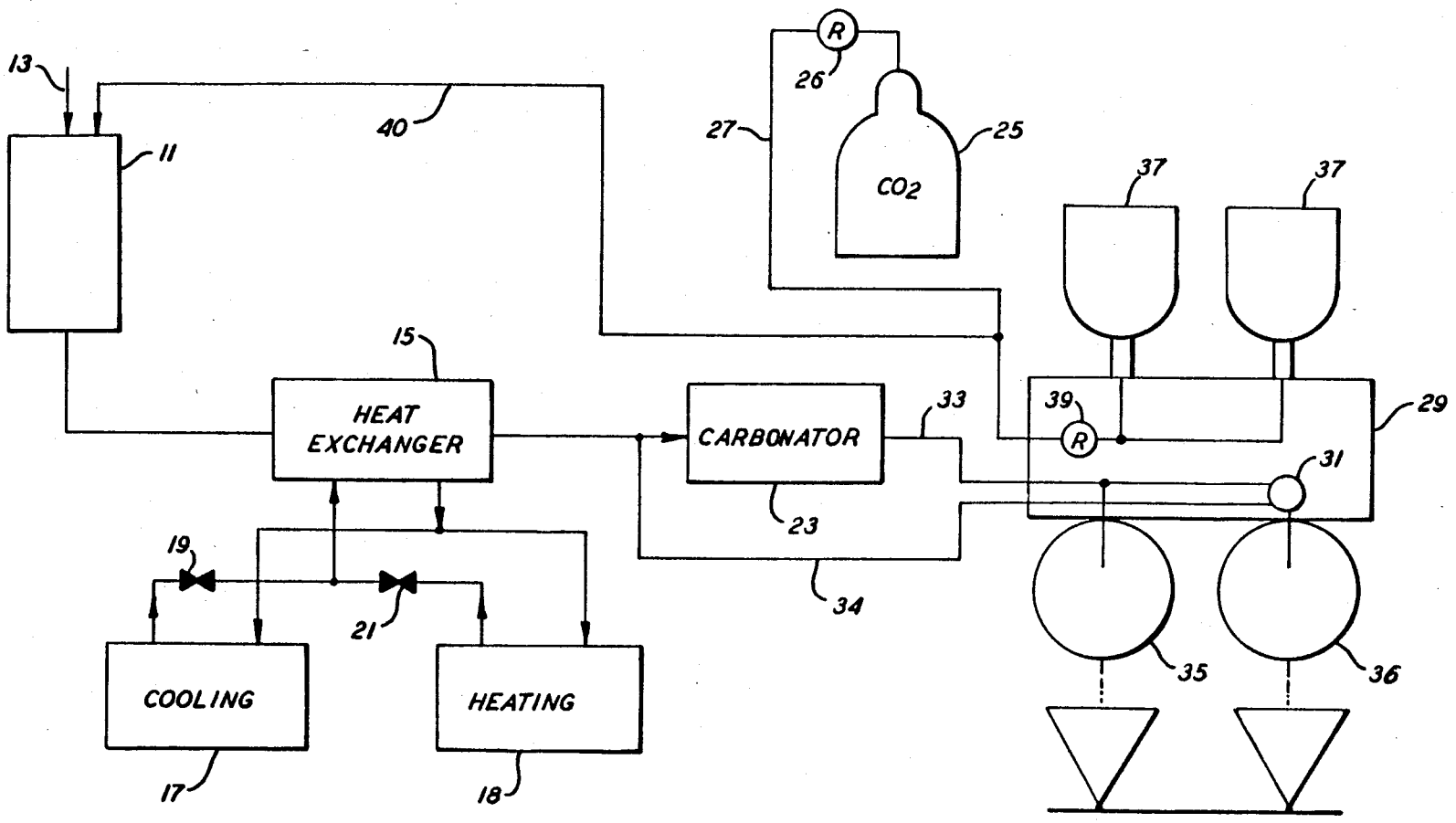
FIG. 1 is a block diagram of a dispensing system utilizing the carbonator of the present invention.

Thus, FIG. 1 is a generalized block diagram of a system according to the present invention. The system includes a water source 11. In more general terms, this is a source of diluent which is later mixed with a concentrate. Although it will, in most cases, be water, other diluents might be used. Shown in connection with the water source is an inlet 13. The inlet 13 may be an inlet which is plumbed into the plumbing of the location where the dispenser is used or may simply be an opening in the water tank which permits refilling. The water from the water source is shown passing through a heat exchanger 15. Shown associated with the heat exchanger 15 is a cooling unit 17 and a heating unit 18. Cooling can be supplied to the heat exchanger 15 by opening a valve 19 and heating by opening a valve 21. In many instances, the heating or cooling will be associated directly with the water source or water tank 11. In general terms, the heat exchanger 15 and associated cooling 17 and 18 simply comprise means for adjusting the temperature of the diluent.

At the outlet of the heat exchanger 15 is a carbonator 23. Carbonator 23 is supplied with carbon dioxide from a tank 25 through a reducing valve 26, a line 27, and a manifold 29. When in use carbonated water is supplied over line 33 to the manifold 29. The manifold 29 supplies this water or other diluent to dispensing valve 35 in accordance with the present invention. Still water is supplied over a line 34 to a mixing valve 31 at the manifold. Mixing valve 31 has a second inlet supplied with carbonated water from line 33 and permits supplying to a dispensing valve 36 any desired proportion or mixture of still and/or carbonated water. Also located at the dispensing valves 35 and 36 are containers 37 filled with a concentrate which is to be mixed with the diluent. As will be more fully described, the metering valve for concentrate is in the container 37 and is coupled to and cooperates with the dispensing valves 35 and 36. That is, the container 37 with the concentrate includes valving means to meter the amount of concentrate in response to a relative movement of two parts of a container brought about by the dispensing valves 35 and 36. The supply of carbon dioxide over line 27 is also used to pressurize the concentrate in the container 37 after being coupled through a reducing valve 39. Also shown is a line 40 coupling carbon dioxide to water source 11 to supply the diluent at a constant pressure. As with the means for changing the temperature of the diluent the carbonator may also be built into the water container as is the case in the embodiment to now be described. In that case, water source 11 is also the carbonator. Furthermore, although carbon dioxide is shown as the pressurizing gas, in embodiments where carbonation is not desired, it may be replaced by any inert gas such as nitrogen.

THE DISPENSING SYSTEM

Figure 2A:
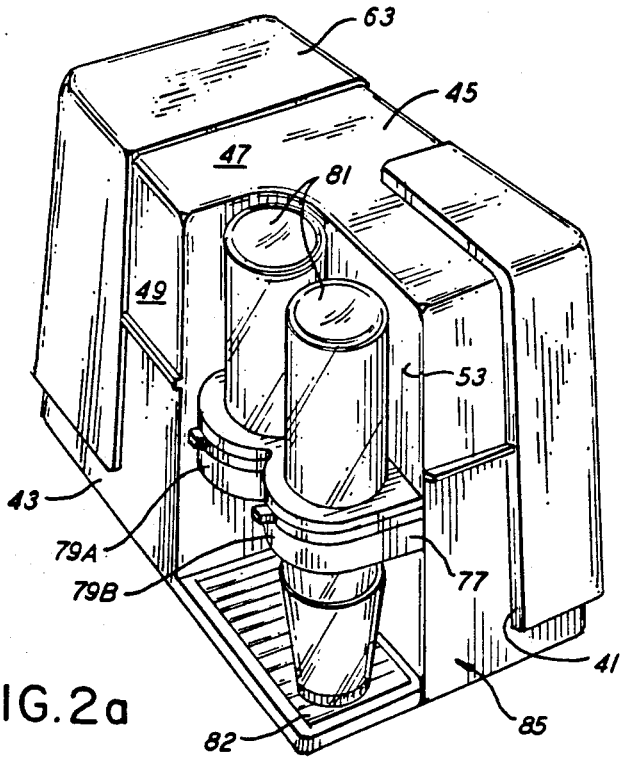
FIG. 2*a* is a front perspective view of a dispenser utilizing this carbonator.
Figure 2B:
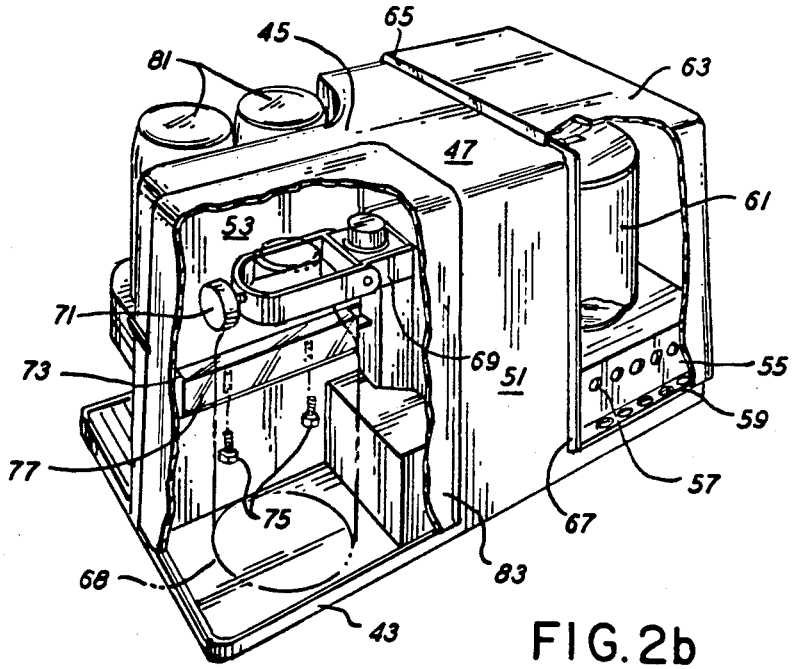
FIG. 2*b* is a front perspective view of a dispenser utilizing this carbonator.

The embodiment of the dispenser of the present invention illustrated in perspective view in FIGS. 2*a* and 2*b* includes a supporting structure 41 which is preferably of molded plastic. Structure 41 includes a base 43 and an upstanding T-shaped portion 45. The T-shaped portion 45 includes a top wall 47 front and rear walls 49 and 51, respectively, and a central divider 53. At the one end of the unit, as best seen in FIG. 2*b*, mounted to the base 43 is a cooling unit 55. Shown in the cooling unit 55 are ventilation openings 57 which communicate with additional ventilation openings 59 formed in the base 43. Disposed atop the cooling unit 55 is a diluent tank, e.g., a water supply and carbonator tank 61 to be described in more detail below. Surrounding this portion of the unit is an insulated cover 63 which has a depending flange portion 65 which engages corresponding lip 67 on the central portion 45. As will be described in more detail below, the carbonator is adapted to be easily removed and refilled with water when necessary. As an alternative to a cooling unit 55, a heating unit, or combined heating and cooling unit, can be provided to permit the possibility of dispensing either cold or hot drinks.

At the other end of the dispensing apparatus, supported on the base 43, is a tank of a pressurizing gas, e.g., a carbon dioxide tank, 68 shown in the phantom. The carbon dioxide tank 68 is connected to a reducing valve 69 by means of a quick disconnect clamp 71 to permit ease of replacement of the carbon dioxide bottle 68. Extending through the dividing wall 53 and secured to a bracket 73 thereon by means of screws or bolts 75 is a manifold 77 which will be described in detail below. The manifold 77 distributes the pressurizing gas and diluent, e.g., carbon dioxide and carbonated water. The front portion of the manifold 77 is visible on FIG. 2*a*. Integral with the manifold are two dispensing valves 79A and 79B to be described in detail below. Disposed above each of the dispensing valves 79A and 79B is a container 81 containing therein a concentrate to be mixed with the diluent supplied from the diluent tank 61. Below valves 79A and 79B is a removable tray 82 retained magnetically, for example, for catching any spillage. Tray 82 may be removed and rinsed periodically. Again, although disclosed hereinafter as supplying carbonated water, it will be recognized that, by disconnecting the carbonator apparatus, still beverages can be dispensed, and, by heating instead of cooling the diluent, hot drinks can also be dispensed. As will become more evident below, the containers 81 are particularly adaptable to packaging and storing all types of concentrate in a sanitary manner.

Covering the carbon dioxide tank 68 is a second cover 83, which similarly has a depending flange 85 engaging a lip on the T-shaped central structure 45.

Figure 3:
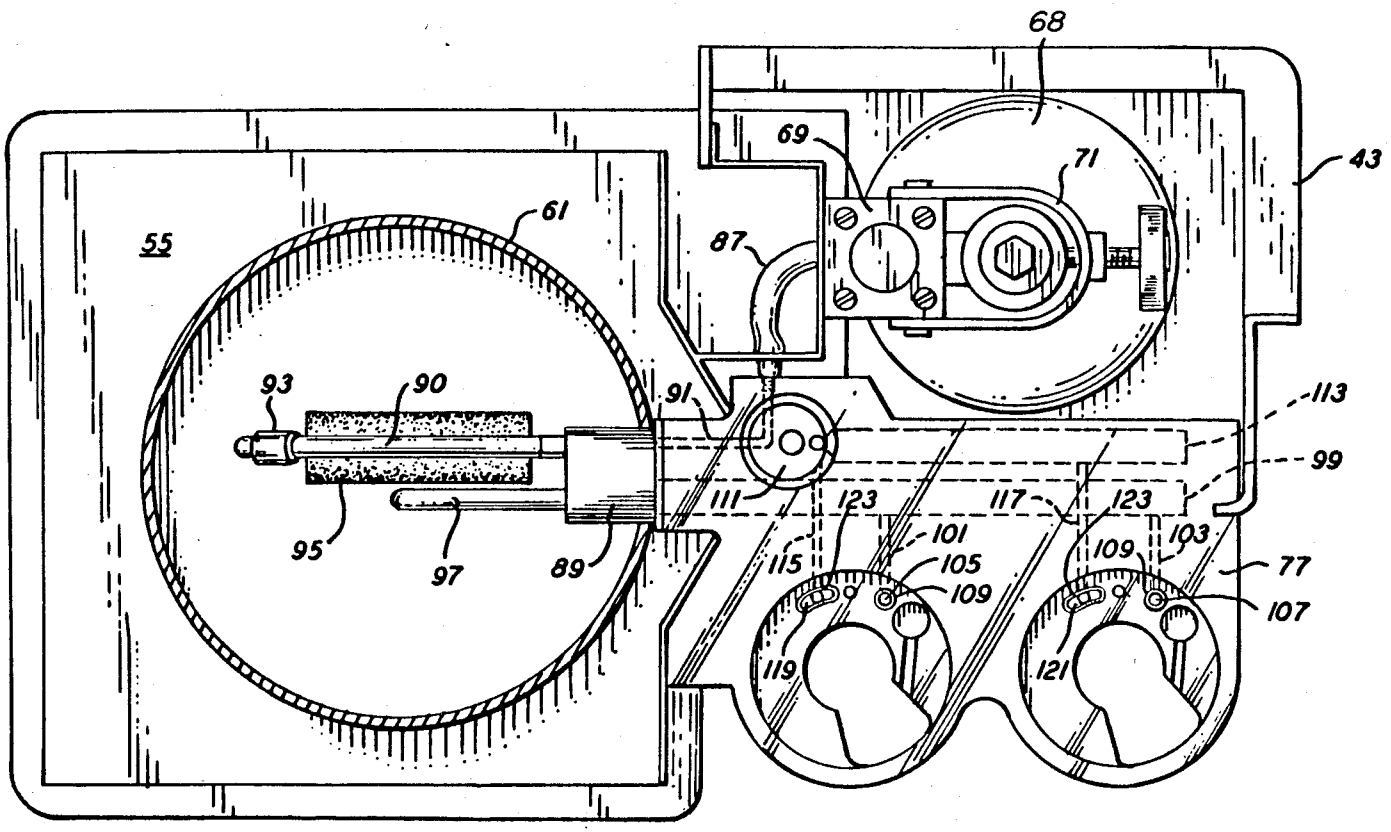
FIG. 3 is a front perspective view of a dispenser utilizing this carbonator.

FIG. 3 is a plan view of the dispenser of FIGS. 2*a* and 2*b* with the covers 63 and 83 removed and the T-shaped center section 45 also removed for clarity of presentation. In this view, the $CO_2$ bottle 68 is visible together with its quick disconnect clamp 71 and pressure regulator 69. The pressure regulator is semi-ridigly mounted and coupled by tubing 87 to the manifold 77. Portions of valves 79A and 79B which are molded integrally with the manifold are also shown. Also shown in cross section is the carbonator tank 61. The carbonator tank contains a coupling 89 which permits a quick disconnect with the manifold 77.

Pressure regulator 69 reduces the carbon dioxide pressure to 40 psi. $CO_2$ at this pressure is fed through a passage 91 in the manifold 77 to the disconnect coupling 89. From that point it flows through tubing 90 to a restrictor 93, and thence to a diffuser 95. Carbonated water is removed from the carbonator tank through a line 97 extending to the bottom of tank 61 and leading to the coupling 89 whence it enters a passage 99 in the manifold. This passage connects with two smaller passages 101 and 103, which lead to outlets 105 and 107, in the portion of the valves which is integral with the manifold. At each of the outlets an O-ring seal 109 is provided. Carbon dioxide is also fed through a further pressure regulator 111 which is built into the manifold 77, where the pressure is reduced to 5 psi. From regulator 111 the carbon dioxide flows in a passage 113 to which are connected two passages 115 and 117, which lead to elongated openings 119 and 121 in the portion of the manifold which comprises part of the valve. Again, in each case an O-ring seal 123 of neoprene or the like is inserted. Although the manifold can be made of various materials, a plastic is preferred. With such plastic the manifold can be molded and any necessary machining carried out to form the various passageways.

THE MANIFOLD

Figure 4:
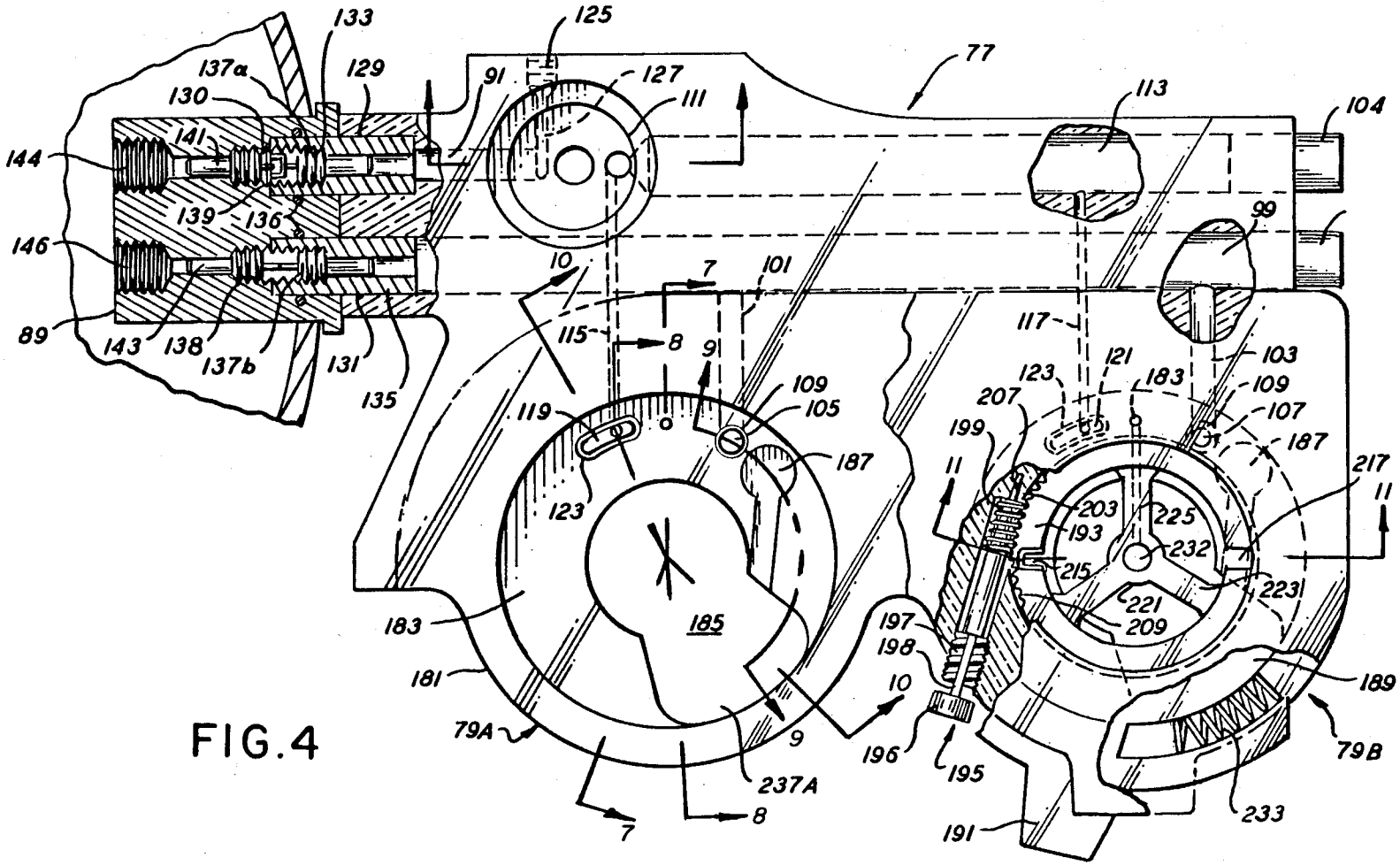
FIG. 4 is a plan view of the valve of FIG. 3 partially cut away showing the valve integral with a manifold.

The manifold 77 and the dispensing valves are shown in more detail in FIG. 4. At the inlet for carbon dioxide, a threaded fitting 125 is provided in the manifold. As illustrated, this communicates with a channel 127 which is connected directly to the passage 91. Inserted into appropriate bores 129 and 131 on the left side of the manifold 77, are tubular fittings 133 and 135. These are press fitted into their respective bores 129 and 131. Each contains, threaded therein, a check valve, e.g., a Schrader type valve 137*a* and 137*b* respectively. The fittings 133 and 135 insert into the quick disconnect coupling 89 in the carbonator tank 61 and are sealed by O-rings 136. Within a bore 130 in the coupling 89, mating with the fitting 133, is disposed an anvil 139 followed by a check valve 141 which is blown open by $CO_2$ pressure from line 91. In a bore 138 of the coupling 89 which mates with the fitting 135 is inserted another Schrader valve 143. The valve 143 abuts against the valve 137*b* opening both valves when the quick disconnect coupling 89 is attached to the manifold. Similarly, the anvil 139 opens the valve 137*a*. In this manner, when the carbonator is disconnected from the manifold, there is a check valve in both passages of the manifold and in both passages into the carbonator to prevent release of pressure. The coupling 89 also contains, at its inside, threaded bores 144 and 146 for connecting lines 90 and 97 of FIG. 3.

Figure 4B:
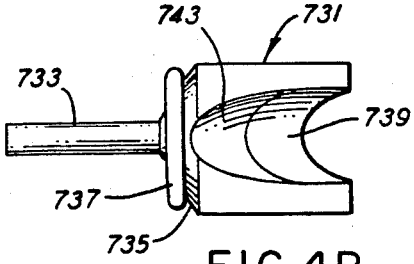
FIG. 4*b* is a side elevation view of a valve core used in the water valves of FIG. 4*a*.
Figure 4A:
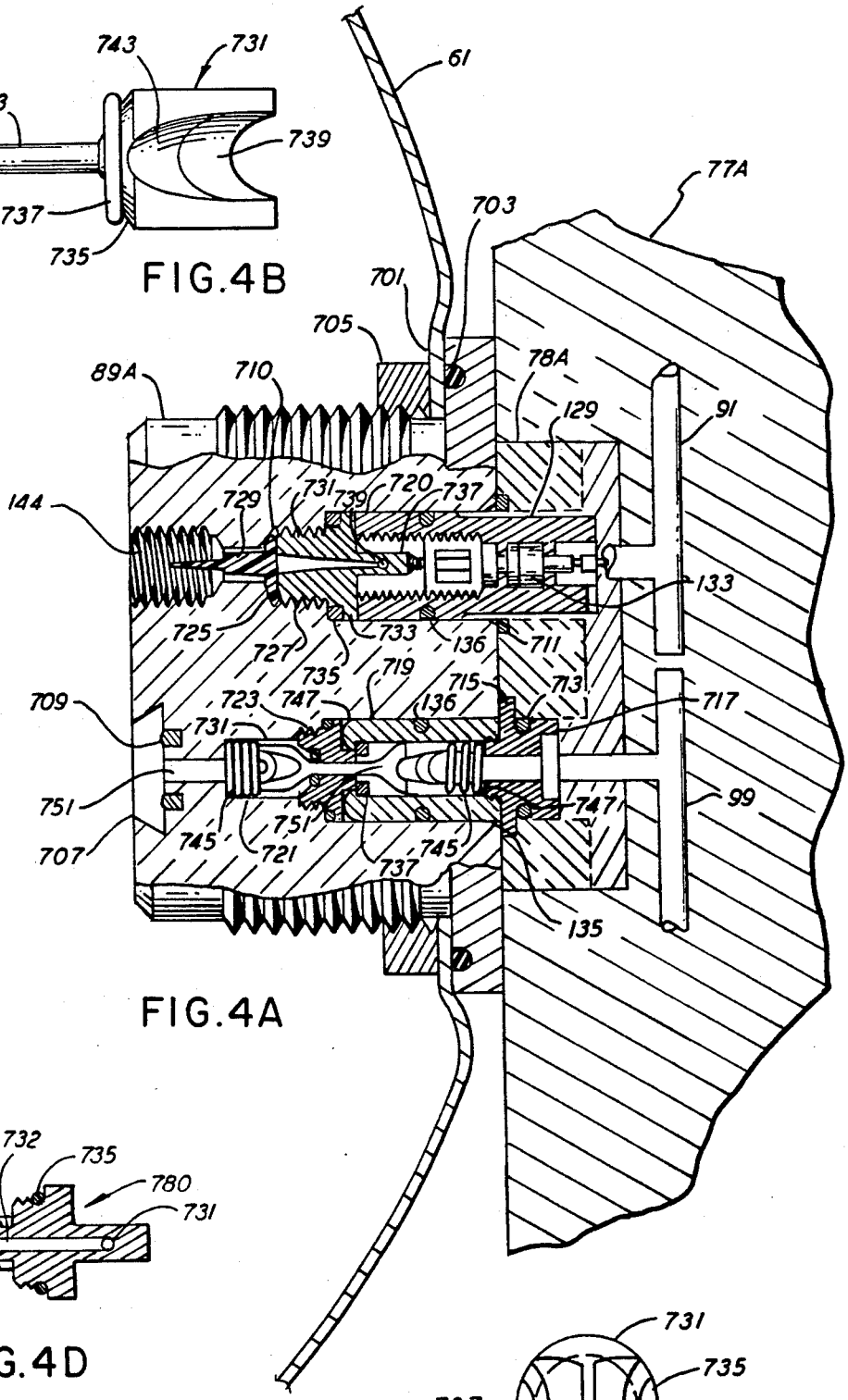
FIG. 4*a* is a drawing illustrating an alternate form of valving at the connection between the manifold and carbonator.

FIG. 4*a* shows an improved form of valving. Although the valving of FIG. 4 is operable, the valving illustrated in FIG. 4*a* provides superior performance. Tests with the type of valving shown in FIG. 4 showed that it gave an undesirable flow restriction in the water outlet and the presence of sharp edges resulted in energy dissipation and de-gassing. With respect to the gas side, it was discovered that a pressure-activated check valve would give superior performance to a Schrader valve of the type illustrated in FIG. 4.

Referring to FIG. 4*a*, in the illustrated embodiment the valve block 89A which is mounted to the diluent tank 61 is, in this embodiment, a molded plastic part of Lucite or the like rather than the stainless steel part of FIGS. 3 and 4. It is secured in place in an appropriate opening in the tank 61 at a flat area 701 thereof by means of a sealing gasket 703 on one side and a lock ring 705 on the other side. Block 89A contains a threaded portion 144 for connection of a diffuser as previously. On the outlet side, it contains a slotted portion 707 with an internal O-ring seal 709 for insertion of a resin bed. A resin bed of the type which can be used with the present invention is disclosed in co-pending application Ser. No. 310,486 filed Oct. 9, 1981 and assigned to the same assignee as the present invention. As in the previous embodiment, fittings 129 and 135 are inserted into the manifold 77A in communication with lines 91 and 99, the gas and water lines respectively. For reasons which will be apparent below, fitting 135 is made of two parts, 719 and 717 which screw together. Part 717 is the one pressfitted into the manifold 77A. O-ring seals 711 and 713 are provided for sealing purposes Inserted into the resting on the base of the bore 725 is the flange of a duckbill valve 729. It is held in sealing contact by a member 731 made of stainless steel screwed into the threads 727. Member 731 contains a flange 733 pressing against an O-ring 735 placed at the base of the bore 720. Extending from the flange is a pin 737 having a cross-bore 739 therein. This communicates with a central bore through the member 731 which communicates with the duckbill valve. The pin 737 acts against the schrader valve 133 which is as in the previous embodiment. Rather than utilizing a duckbill valve, a ball and spring check valve could equally well be used. The key requirement is that the valve be one operated by the gas pressure to open and that it act as a check valve to be closed against pressure from inside the carbonator.

Figure 4D:
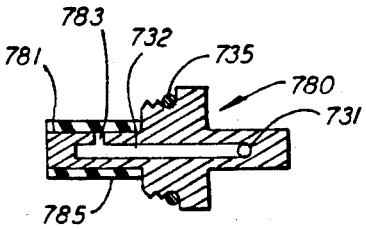
FIG. 4*d* is a side elevation view of an alternate embodiment of a valve ussed in the valving of FIG. 4*a*.

Another alternative to the duckbill valve is the sleeve valve illustrated by FIG. 4*d*. This arrangement takes the place of not only the duckbill valve but also member 731 which holds the duckbill valve in place. In effect, a member 780 of design similar to member 31 has a portion 781 extending below the threaded area. Central bore 732 extends through this portion 781 with flow controlled, both in this case and the previous case, by the size of the opening 731 of the cross bore. Again, an O-ring 735 is rpovided for sealing. Valve action is accomplished by means of a radial port 783 extending to the circumference of the extension 781 and an elastic sleeve of water resistant material, preferably silicone rubber, covering the extension 781.

Figure 4C:
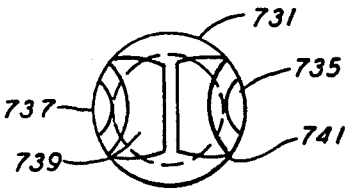
FIG. 4*c* is a bottom view of the valve core of FIG. 4*b*.

On the water side, in the manifold and in the coupler 89A, a type of valve which gives adequate flow, has smooth surfaces and which does not contribute to energy dissipation or degassing is used. FIG. 4*b* is an elevation view and FIG. 4*c* an end view of the type of valve generally indicated as 731 used at these locations. The valve includes a stem 733 of cylindrical cross-section. The stem extends from a conical section 735. The conical section is shown in abutment with an O-ring 737 to demonstrate the nature of the seal made by the valve. In operation, lifting away from the O-ring 737 by movement of the stem 733 opens the valve. The conical shape 735 provides self-centering. From the view of FIG. 4*c*, the base of the conical section 735 is visible. The location of the O-ring seal 735 seated thereon is also visible. As illustrated, there are angled two semi-circular cuts made on each side of the valve core. Thus, from the bottom view, one can see the cuts 739. These terminate in a thin section 741. In the upper portion on each side, a cut 743 is made extending from the cut 739 to a position above the base of the conical section 735 so as to bridge that part. Thus, flow from the bottom at the base 741 flows along the smooth surfaces past the conical section 735 and in an annular path between the O-ring 735 and the stem 733.

Referring again to FIG. 4*a*, at the base of the recess 721 a spring 745 is disposed. Similarly, within a central bore 747 in the coupling member 135, another spring 745 is disposed. The spring seats against a threaded insert 717 which is screwed into the end of part 135. At the inner end of the bore 747 in part 135 an O-ring 737 is disposed. Similarly, an O-ring is contained in a recess in a member 747 screwed into the threads 723. As illustrated, the stems 733 of the two valve cores are abutting against one another, thereby separating the conical parts from the O-rings 737. In the assembled position shown, the springs 745 are essentially completely compressed. In this position, water flow from the passageway 751 which communicates with the resin bed in the carbonator tank flows past the two valves and eventually reaches the water line 99 in the manifold.

THE CARBONATOR AND COOLING SYSTEMS

Figure 5:
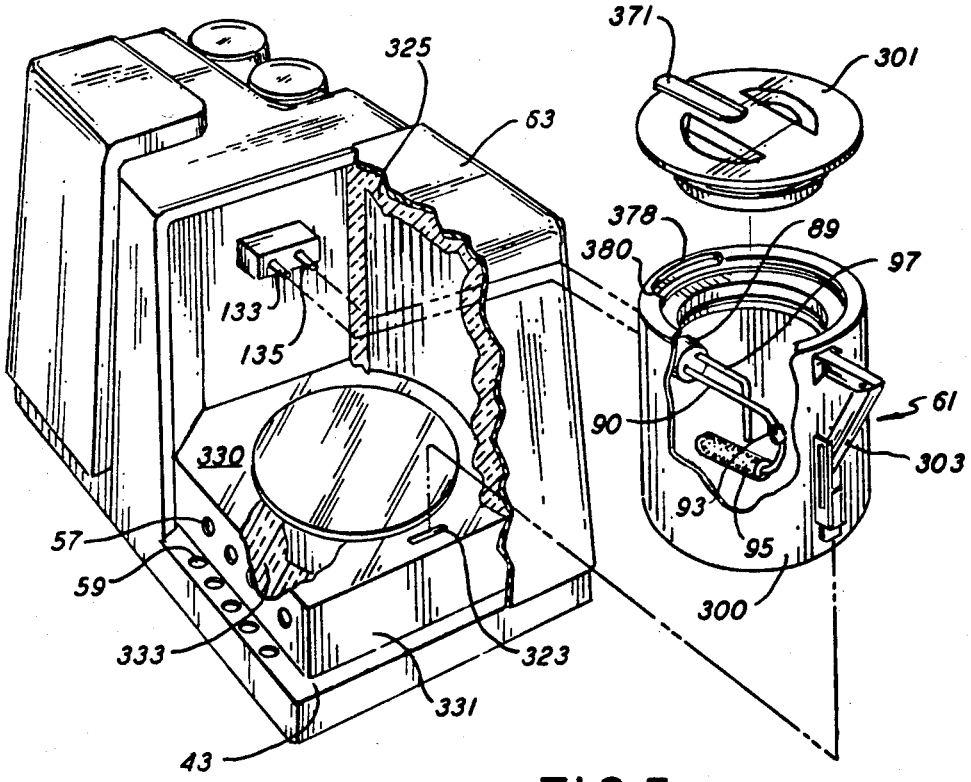
FIG. 5 is an exploded view of the dispenser showing the carbonator of the present invention.

The remainder of the system is also designed with a view toward ease of operation and low cost. The fact that a quick disconnect coupling 71 is provided for the carbon dioxide bottle 68 has already been noted. In addition the quick disconnect nature of the carbonator has also been noted. The carbonator will now be explained in more detail in connection with FIG. 5 which is an exploded perspective view of the dispenser showing the manner of insertion and removal of the carbonator. In the disclosed embodiment of the drink dispenser of the present invention, the unit is free-standing, i.e., it is not connected to the plumbing. It will be recognized that with respect to what has been previously disclosed, i.e., with respect to the dispensing arrangement and the manifold, such can be equally well used in a plumbed-in or an automatically recharging unit if provided with the necessary controls, e.g., temperature, level, etc. In the unit of FIG. 5, the carbonator 61 comprises a metal tank 300 preferably of stainless steel or aluminum, having a lid 301 which is removable in order to refill the carbonator 61 with water. As previously explained, the carbonator 61 includes a quick disconnect coupling 89 from which one line 90 leads through a restriction or orifice 93 to a dispersion block 95. Carbonated water is forced out of the unit through a line 97. Also shown in FIG. 5 is the end of the manifold 73 with the two connecting fittings 133 and 135 projecting therefrom. As explained in detail in connection with FIG. 4, these insert into appropriate bores in the fitting 89. As also explained in connection with FIG. 4, there are valves both in the fitting 89 and the connecting stubs 133 and 135 of the manifold. Hence, when the tank 61 is pulled away and disconnected from the manifold, the pressure within the dispensing unit, i.e., that pressurizing the containers 81 and the carbonated water in the various passages, which is under pressure, and the gas under pressure being fed from the $CO_2$ tank are not released. Without such valving, carbonated water would be released from the connecting fitting 135 and the 40 psi carbon dioxide would flow from the fitting 133.

At the same time, the valves within the coupling 89 prevent the carbonated water under pressure from being discharged from carbonator 61 and also prevent any discharge through the carbon dioxide inlet. In order to aid in the quick disconnect of the carbonator tank 61 and also aid in handling it when disconnected, i.e., to permit refilling, a folding handle 303 is provided. A view of the handle 303 is also provided in the cross section of the carbonator shown on FIG. 6. The handle includes a bracket 305 which is attached vertically to the carbonator tank 300. This is essentially a U-shaped bracket which contains a cutout portion 307 in is central portion, i.e., at this portion only the base of the U is present. The handle itself comprises two arm sections, an upper arm section 309 and a lower arm section 311. The two arm sections are hinged together by means of a pin or rivet 313. The upper arm section 309 is also hinged to the upper part of the bracket 305 by means of a pin or rivet 315. The other end of the lower arm 311 contains a pin or rivet 317 which passes through a slot 320 formed in the U-shaped bracket 305 near its bottom and is retained in place by washers 319. Also hinged to the pin 317 is a downwardly extending retaining pin 321. In the position shown in solid lines on FIG. 13, with the handle folded against the tank 300, the pin 321 extends through an appropriate hole 323 in a support plate 330 in the top of the cooling unit 55. This, along with the insertion of the connecting stubs 133 and 135, into the fitting 89, retains the tank 61 in the correct place against the tension of the springs in the check values. Alternatively, coupling 89 could be on the bottom or vertically disposed on the side of carbonator 61 and the weight of carbonator 61 used to help to maintain the connection.

When it is desired to remove the tank, after removal of cover 63, the handle 303 is moved to the position shown in dotted lines. The pin 317 slides upward in the slot 320 at the same time carrying with it the retaining pin 321. It is now possible to remove the carbonator to refill it with water.

Figure 6:
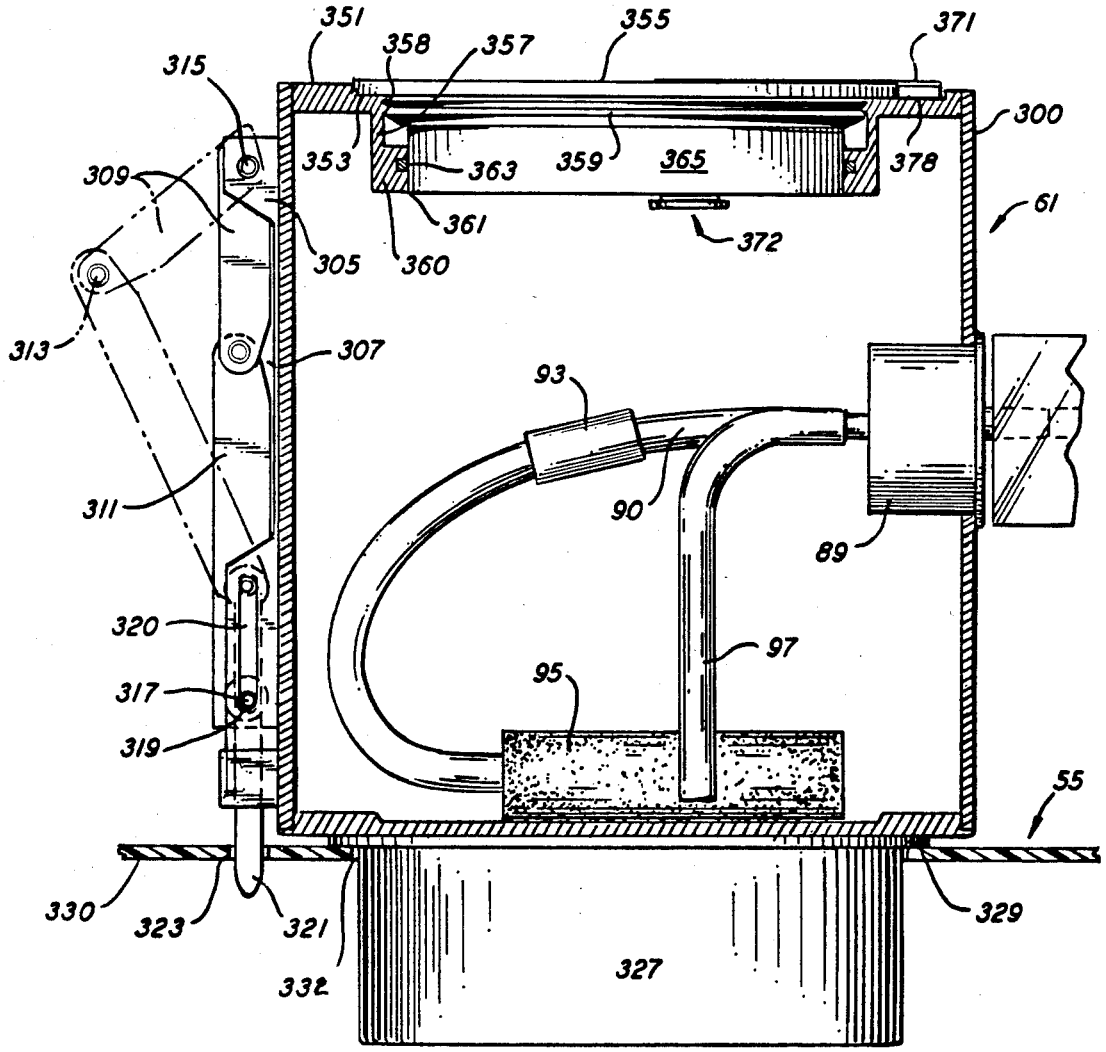
FIG. 6 is a sectional elevation view of the carbonator of FIG. 5.

Since the carbonator after being removed for refilling will still be under a pressure of 40 psi it is essential that the pressure be released before the cover is removed. Otherwise, the cover could blow off possibly causing serious injury to the user. Furthermore, it is important that a good seal be maintained between the cover 301 and the container 300. The present invention provides a novel design of the mating of the cover with the container which both insures that the cover cannot be removed until the pressure is released, and at the same time insures that the cover will always be adequately sealed, after the carbonator is refilled. The manner in which the cover fits into the container 300 is best illustrated by FIGS. 5 and 6.

The container 300 at its top 351 (the container is of solid welded construction) has a stepped profile. It has an upper recess 353 of first internal diameter in which a top flanged section 355 of the cover 301 rests. Following this is a portion 357 of somewhat smaller internal diameter containing internal threads 358. The cover 301 contains matching external threads 359 which screw into the threads 358 but which extend to a greater depth on the lid than on the portion 357. This section is followed by a section 360 of still smaller internal diameter which contains on its vertical surface 361 an O-ring seal 363. O-ring seal 363 seals against a cylindrical circumferential portion 365 of the cover. Because of the location of the seal 363, a radial rather than the conventional axial type seal takes place. What this means is that the carbonator will be sealed even if the cover is not screwed on completely tightly, in contrast, with an axial seal, where good sealing depends on the cover being screwed on tightly. This essentially eases operation for the user, typically a housewife, and does not require critical alignment or the application of a certain amount of pressure in order to get good sealing.

Figure 9:
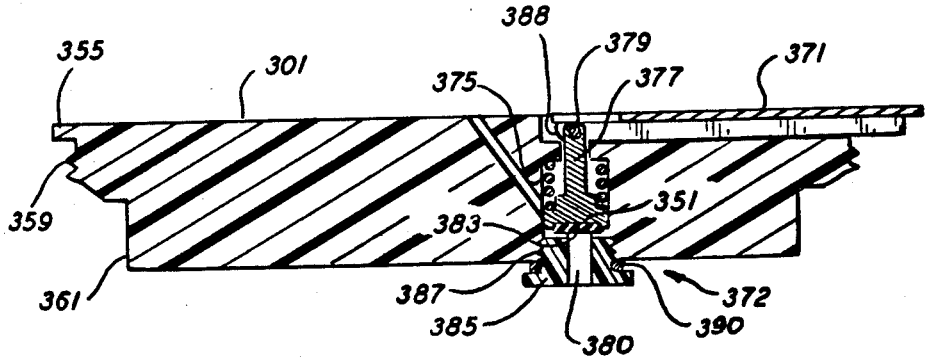
FIG. 9 is a sectional elevation view of the carbonator lid of FIG. 5.

In order to ensure that pressure is released before the cover is removed, a rotatable handle 371, shown on FIGS. 5 and 9, is provided. This handle rotates to operate a relief valve 372, the lower portion 373 of which is visible in FIG. 6.

As shown in FIG. 9, handle 371 is hinged to a plunger 377 by means of a pin 379. Plunger 377 has, in a recess 351 at its end, a rubber sealing disc 383. This seals against a plastic valve seat member 385 containing a central bore 380 which is screwed into a threaded bore 387 in the lid 301 and sealed against the bottom of lid 301 with an O-ring seal 390. A spring 375 biases the plunger 377 against seat member 385. Rotation of handle 371 upward lifts plunger 377 off seat member 385, by means of a larger radius 388 at the handle end, to release the pressure in the carbonator 61 through a vent bore connecting the biasing spring chamber to atmosphere. This valve also acts as a safety valve in that if the pressure exceeds an amount determined by biasing spring 375, the plunger 377 will lift off seat member 385 the pressure being released through the vent bore as discussed above.

Figure 12A:
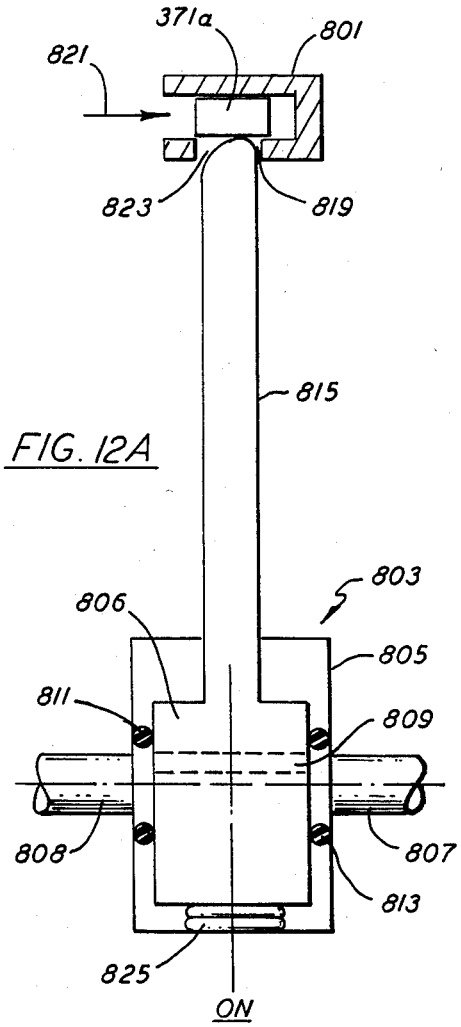
FIGS. 12*a* and 12*b* are schematic views of valving associated with the arrangement of FIG. 11 to cut off the flow of carbon dioxide prior to the lid being allowed to open.

Thus, rotation of the handle 371 upward when it is desired to refill the container, automatically opens the valve to release the pressure. Unscrewing of the cover 301 without operating the handle 371 is prevented by having the handle 371 extend beyond the circumference of the uppermost portion 355 of the cover. A cutout 378 is formed in the top 351 of the container 300 as best seen in FIG. 12. When cover 301 is screwed into place, the handle 371 snaps into this cutout 378. When one attempts to unscrew the cover without lifting the handle 371 it will come into contact with the edge 380 of cutout 378 preventing further turning until the handle is lifted and the pressure released. Furthermore, because of the pressure, turning will be very difficult, by hand, without first releasing the pressure. This too is a reminder to operate handle 371. Finally, should handle 371 be broken off, or the vent valve fail to operate and someone uses a wrench or the like to generate enough torque to turn the cover when the vessel 61 is under pressure, leakage past the threads, which will still be engaged when the seal at O-ring 363 is broken, will bleed the pressure off before the cover 301 is free of tank 300.

FIGS. 10*a–d* illustrate an alternate embodiment of a closure for the carbonator lid. Shown is a carbonator lid 301*a* with a cylindrical opening 501 therein. Inserted within the opening 501 is an insert 503 having a first cylindrical section 505 press fitted into the opening 501 followed by an outwardly flared section 507 and a terminating cylindrical section 509.

The closure, or stopper mechanism, which is utilized to close the opening in the cover 301*a* is of a nature similar to devices used as stoppers for vacuum bottles and also as boat plugs. However, as with the previously described cover for the carbonator, it is necessary that such a closure incorporate means to insure that pressure is relieved before the cover or stopper is removed, and it is also desirable that the closure be capable of performing as a pressure relief valve. The arrangement illustrated on FIGS. 10*a–d* accomplishes all of these functions. The member which actually closes the opening comprises a compressible stopper of rubber, for example. The stopper, which is of cylindrical shape with a central bore 512, in the uncompressed state (See FIG. 10*d*), is fitted over a tube 513. At its inner end tube 513 is threaded. At the inner end of the stopper is a washer 515 which is held in place by a nut 517 screwed on to the threaded end of tube 513. The stopper 511 is compressed between washer 515 and a washer 519 at the outer end of the stopper, also slid over the tube 513. The tube 513 contains a bore 521 in its outer end which terminates in a conical valve seat 523. A smaller bore 525 extends from the valve seat through to the inner end of the tube 513. At the end of the tube projecting through the washer 519, the tube is slotted to provide two diametrically opposed members or ears 527 and 529. Each of the ears 527 and 529 contains a hole 531 through the center thereof. A bolt 533 on the end of which is a nut 535 passes through these holes and through corresponding holes 537 in camming means 539. Camming means 539 comprise a member of essential U-shaped cross-section with two identical cam surfaces 541 on the legs thereof on the end of which is a U-shaped lever arm 543. The cam surfaces 541 act against the washer 519. In the position shown in FIG.

10*a*, the distance between the bolt 533 and the circumference of the cam surface 541 is a maximum. This in turn causes the bolt and with it the tube 513 to move outward compressing the compressible stopper 511. In the position shown in FIG. 10*c*, the radius of the cam surface 541 remains essentially the same, still maintaining compression. Finally, in FIG. 10*d*, the distance between the bolt 533 and the flattened portion 541*a* of the cam surface is now reduced to permit the compressible stopper to take the cylindrical form shown in FIG. 10*d* and allow its removal.

What has this far been described is a conventional compressible stopper arrangement typically used in vacuum bottles and as a boat plug. The primary difference is that the conventional device does not have a hollow rod such as the tube 513 but a solid rod.

In accordance with the present invention, seated against the valve seat 523 is a valve member 545 on the end of a rod 547. The rod extends, with a spacing, through a threaded plug 549, which is screwed into internal threads in the end of the tube 513 and provides a guide for rod 547. Biasing spring 551 is disposed between the guide 549 and the valve member 545 biasing the valve member against the seat 523. The end of the rod 547 is attached to an oval ring 553. Between the two ears 527 and 529, a cam 555 is mounted to bolt 533. Bolt 533, at least in the central part thereof, has a square cross-section so that the cam 555 turns with the bolt and the camming means 539. Ears 527 and 529 are, of course, mounted so that the bolt 533 turns within them e.g., the bolts is round where it passes through ears 527 and 529.

Figure 10D:
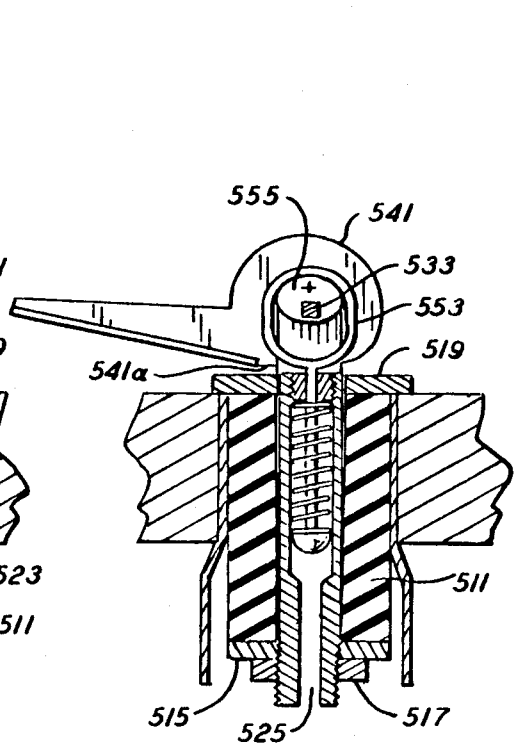
FIGS. 10*a–d* are views of an alternate embodiment of a closure for the carbonator lid.
Figure 10C:
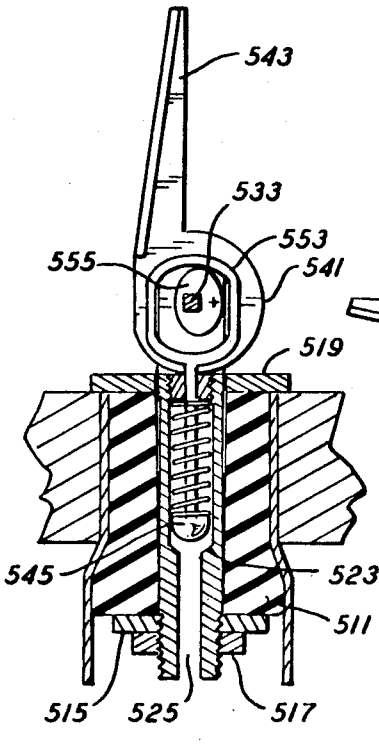
Figure 10B:
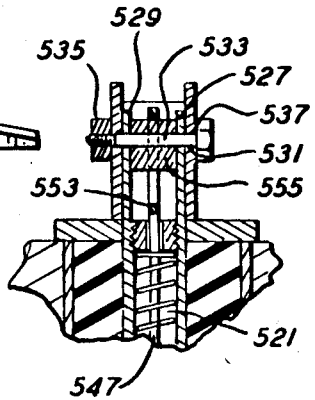
Figure 10A:
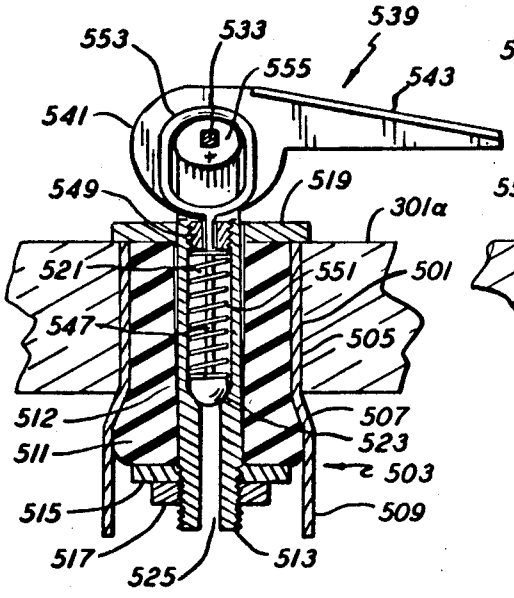

In the position shown in FIG. 10*a*, there is a slight spacing between the oval ring 553 and the cam 555. This allows the biasing spring 551 to bias the valve member 545 against the seat 523 to prevent the passage of fluid. The spring force is selected to provide a biasing pressure which will counteract the design pressure within the vessel with which the closure is used. For example, when used in the carbonator of the present invention the spring would be set for a pressure slightly greater than 40 psi. If excessive pressure builds up within the carbonator tank the valve acts as a pressure relief valve. The biasing force of spring 551 is overcome and the pressure within the tank will lift the valve member 545 off the seat allowing excess pressure to be relieved. The fluid, e.g., carbon dioxide, under pressure would flow through the bore 525 past the valve member 545 through the bore 521 escaping between the rod 547 and the opening in the guide member 549. In order to permit pressure relief, the rod is disposed within the guide member 549 with a small spacing. The nature of cam 555 is such that in the position shown in FIG. 10*a*, the distance between the axis of the bolt 533 and the cam surface is a minimum. As noted above, in this position there is a slight spacing between the cam surface and the ring 553. At the position shown in FIG. 10*c* in which the handle 543 has been rotated through 90°, a second, larger distance, results. Because of this, the cam surface comes into contact with ring 553 raising the ring and with it, the rod 547. This lifts the valve member 545 from the seat 523 and allows a pressure reduction through the valve which will take place at a controlled rate based on the valve orifice and the cross-sectional area between the rod 547 and the hole in the guide member 549. As noted above, in this position, the cam surface of cam 541 is still maintaining the compressible stopper in the compressed state. Finally, as shown in FIG. 10*d*, further rotation of the handle 543 releases the stopper while at the same time maintaining the valve member 545 raised from the seat 523. This results because the cam surface of cam 555 is such that between the position shown in FIGS. 10*c* and 10*d* it maintains the ring at the same distance from the axis of the bolt 533 holding the valve open.

CARBONATOR COOLING SYSTEM

As illustrated in FIG. 5, since the carbonator is cooled, the cover 63 will contain, on its inside, a layer of insulation 325. Cooling is accomplished one of two ways. In the embodiment shown on FIGS. 5 and 6, cooling is done utilizing a pan 327 of essentially cylindrical shape and having a lip 329 at its top. The pan is filled with what is commonly known as "Blue Ice", a type of material typically used for cooling in picnic coolers. The pan containing the Blue Ice sealed therein is placed in a home freezer and frozen prior to use. It is then inserted into the dispenser. For this purpose, a support plate 330 having a circular opening 332 therein to receive the pan 327 is provided. The plate 330 is supported in conventional fashion on a rectangular frame 331 which forms part of the cooling unit. In addition, the inside of the rectangular frame 331, this frame resting on the base 43 of the dispensing unit, contains insulation 333 to prevent rapid melting of the Blue Ice.

Shown on FIG. 5 are ventilation holes 57 in the rectangular frame 331, and ventilation holes 59 in the base 43. These are not required with this type of cooling unit but are used with the cooling unit to be described in connection with FIG. 7 below. The plate 330 in which the pan 327 is inserted is preferably of a material with poor heat conductivity, such as polypropylene.

Figure 7:
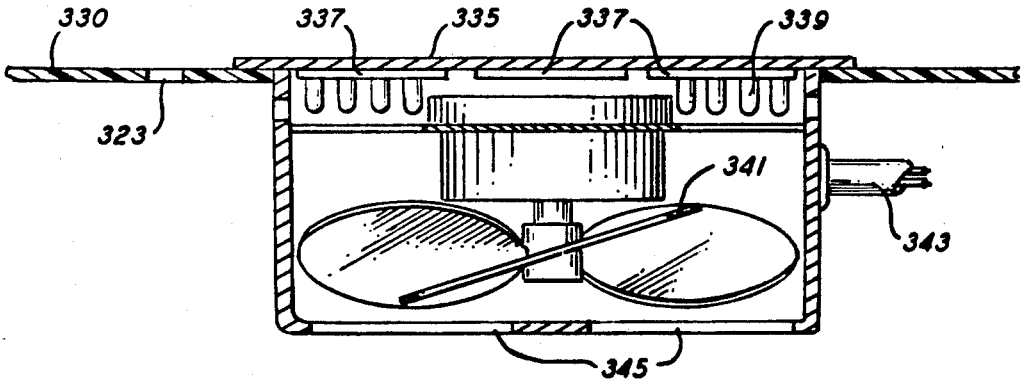
FIG. 7 is a sectional elevation view of a thermoelectric cooling arrangement for the carbonator.

In the alternate embodiment shown in FIG. 7, the dispenser is provided with an electrical cooling unit. Once again, this unit is inserted in, or provided in conjunction with, a plate 330, of poor heat conductivity. Again, the plate contains an opening 323 for the insertion of the pin 321 on the handle 303 of the carbonator 61. The electrical cooling unit includes, below a plate 335 of good heat conductivity, a plurality of thermoelectric cooling units 337. The nature of these units is that there is a temperature gradient established between the opposing side when electrical current is passed through them. The thermoelectric units, which are essentially of a plate-like material, have their cold side abutting against the plate 335. Attached to their warm side are heat sinks 339. Below the heat sinks, a fan 341 is mounted for establishing a flow of cooling air to remove heat from the heat sinks. Power is supplied to the fan and to the thermoelectric cooling units 337 by means of the power line 343. The circuit of this unit is described below in connection with FIG. 8. When operating with such a unit cool air is drawn through openings 345 (FIG. 7) below the fan, warm air is exhausted through the openings 57 and 59 shown on FIGS. 5 and 2*b*.

Figure 8:
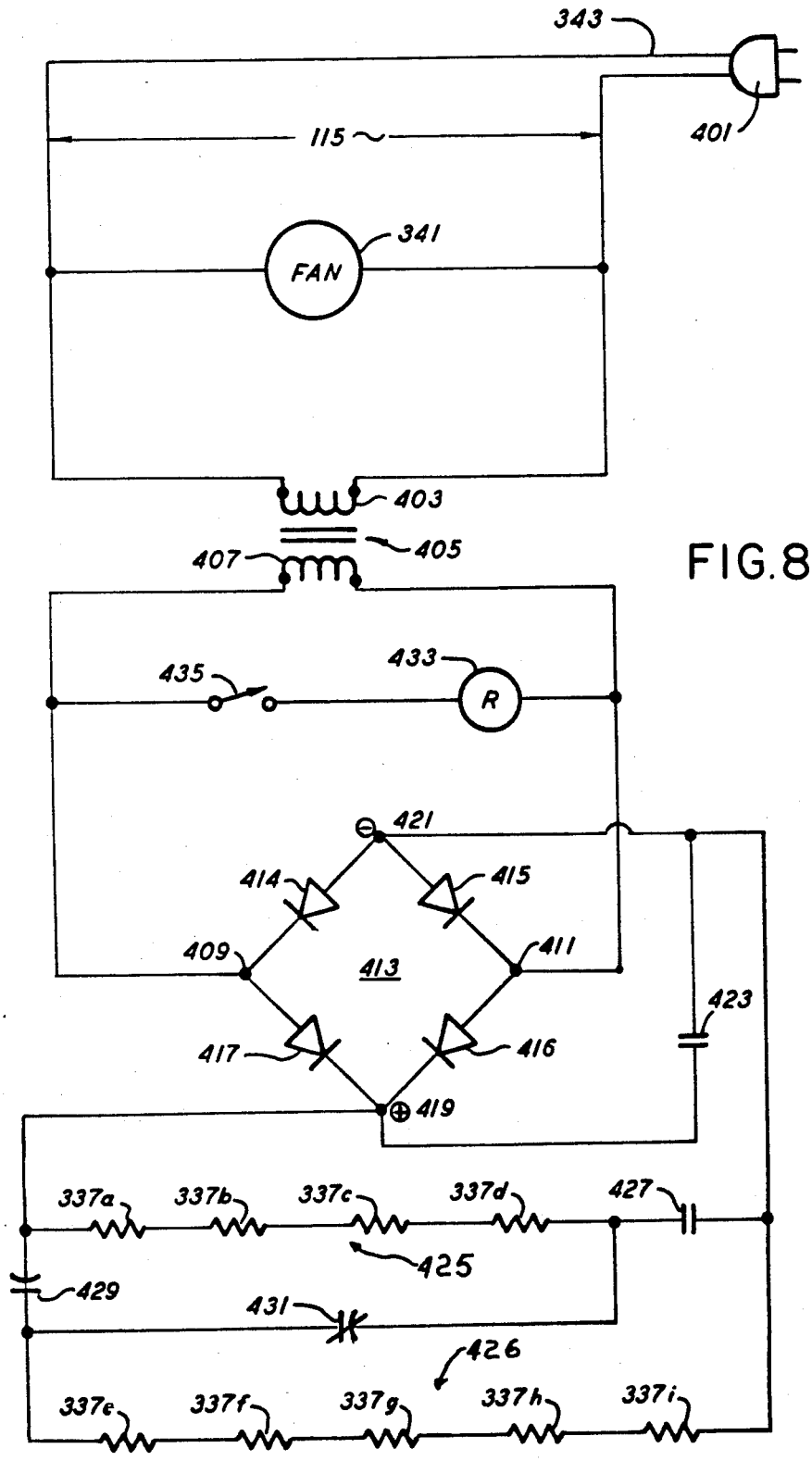
FIG. 8 is a schematic diagram of the cooling system of FIG. 7.

FIG. 8 is a schematic diagram of the circuit for the thermoelectric cooling elements 337 of FIG. 7. The power supply cable 343 has on its end a plug 401 to be plugged into a conventional outlet to supply power at the line voltage to the cooling system. Fan 341 is coupled across the two sides of the AC power line 343. Also coupled across the line is the primary 403 of a transformer 405. The secondary 407 of transformer 405 is coupled to two diagonals 409 and 411 of a full wave rectifier bridge 413 comprising diodes 414–417. At the other two diagonals 419 and 421 of the bridge, rectified DC, at approximately 18 volts is taken off. A capacitor 423 is placed in parallel across the diagonals 419 and 421 to filter the DC voltage. The plurality of thermoelectric cooling elements 337 are arranged in series in two groups. The first group 425 comprises the elements 337 *a–d* in series, and the second group 426 elements, 337 *e–i*, in series. The free end of the thermoelectric element 337 a in group 425 is connected to the bridge terminal 419. The free end of the element 337*d* is coupled through a normally open relay contact 427 to the opposite diagonal 421 of bridge 413. The other group 426 has its one end, the free end of element 337*i*, coupled to the terminal 421 of the bridge 413, and its other end, the free end of element 337*e* coupled through a second set of normally open contacts 429 to the terminal 419 of the bridge. The end of the element 337*e* coupled to the contacts 429 is also coupled through a set of normally closed relay contacts 431 to the end of the element 337*d* coupled to the contacts 427. Contacts 427, 429 and 431 are operated by a relay coil 433 which is connected across the secondary 407 of transformer 405 in series with a switch 435.

In operation, once the plug 401 is plugged into an appropriate wall outlet and power is being supplied over the power line 343, the fan 341 will immediately begin operating. The line voltage applied across the primary 403 of transformer 405 will be stepped down to approximately 12 volts which will then be rectified in the bridge 413 to provide a DC voltage of approximately 18 volts at the output terminals 419 and 421 of the bridge. This DC voltage will be smoothed and filtered by the capacitor 423. The polarity of the DC voltage is positive at the terminal 419 and negative at the terminal 421. The thermoelectric elements 337*a*–337*i* are appropriately poled in accordance with these polarities. In the condition shown, with the switch 435 open, the relay 433 will not be energized. Thus, contact 431 will be closed and the contacts 427 and 429 opened as shown. The DC voltage will flow from the terminal 421 through the series circuit 425, through the closed relay contact 431, and the series circuit 426 back to the terminal 419. In other words, in this condition, all of the thermoelectric elements 337*a*–337*i* are in series across the output of bridge 413. The nature of the thermoelectric elements is such that their degree of cooling is proportional to the current. Furthermore, the elements are resistive in nature. Thus, with all elements in series, the current which is determined by the sum of the resistances will flow. Typically, this current is approximately 8 amps. This establishes a first, lower level of cooling.

When the switch 435 is closed, the relay 433 is energized opening contact 431 and closing contacts 427 and 429. As a result, the two series circuits 425 and 426 are now connected in parallel across the output terminals 419 and 421 of the bridge 413. The current flowing through each of the two parallel branches comprising the series circuits 425 and 426 will now be determined by the number of elements in each of the series circuits. Since this is a smaller number in each case than when all elements were connected in series, greater currents will flow in each of the two parallel branches. This will then result in a greater cooling effect. The thermoelectric cooling elements can be of the type manufactured and sold by Cambion Electric, Cambridge, Mass.

FIXED CARBONATOR

Figure 11:
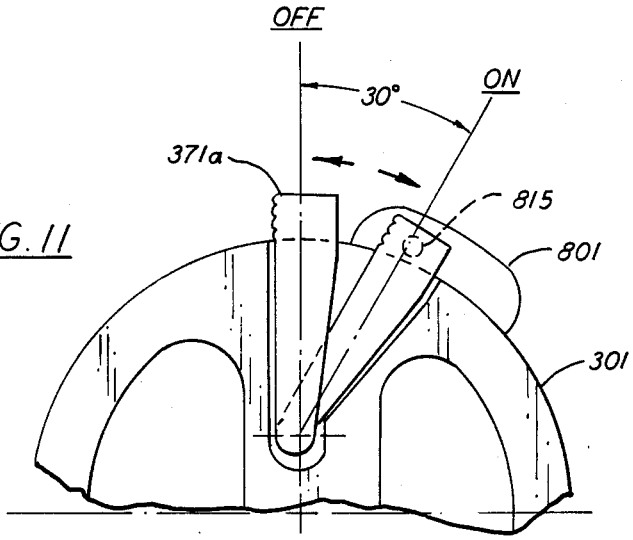
FIG. 11 is a plan view of part of a carbonator lid for use with a fixed carbonator.
Figure 12B:
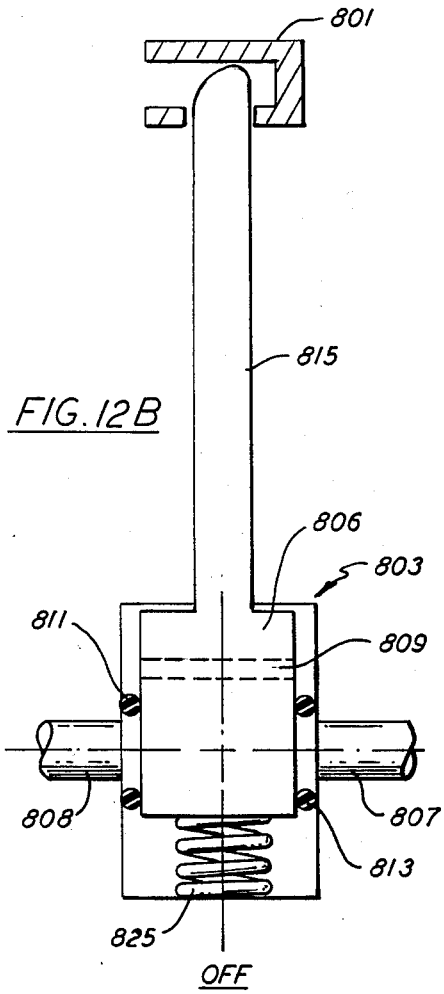

FIG. 11 shows a partial top view of a fixed carbonator. In general, the construction of the carbonator is the same as described in connection with FIGS. 5 and 6. The primary difference is that the handle 317A in the top 301A is rotatable between an off position and an on position. In the off position, the handle may be lifted to vent the carbonator in the manner described previously. In the on position, it is retained below a bracket 801. The structure of the bracket 801 and a further function of the handle is illustrated by FIG. 21*a* and FIG. 12*b* showing respectively on and off positions. Located below the bracket 801 is a valve mechanism 803 for interrupting flow of gas to the carbonator when it is opened. With the removable carbonator previously described, the carbonator will be disconnected from the manifold before it is opened. However, with the fixed carbonator, the carbon dioxide supply remains active at all times. Thus, there must be a safety device to insure that the carbon dioxide flow to the carbonator is shut off before the carbonator is opened. This is the purpose of valve 803. The valve includes a valve body 805 having an inlet line 807 from the regulator and an outlet line 808 to the carbonator coupling 89 or 89A. In this case the carbonator coupling has no valving in it. Disposed within the valve body 805 is a regulator plunger 806 having a passage 809 therethrough. The plunger seals against O-ring seals 811 and 813 at the outlet and inlet respectively. Connected to the plunger and extending out from the body is an activator rod 815. The activator rod is acted upon by the handle 371A which is retained within the bracket 801. The bracket is of generally U-shaped cross-section and contains a hole 819 through which the plunger extends. When the handle 370A is moved to the on position in the direction of arrow 821, it acts against a bevelled portion 823 of the activator rod 815 to push it downward to cause the passage 809 to bridge a path from the inlet 807 to the outlet 808. The plunger and activator rod are biased upwardly by a spring 825. Thus, when the handle is moved to the off position, spring 825 moves the regulator plunger 806 upwardly resulting in the passage 809 now being above the O-ring seal 811. There is no longer a flow path from the inlet 807 to the outlet 808. As indicated, the activator rod 815 then moves upwardly to abut against the top of the bracket 801.

As an alternate, a pinch valve mechanism can also be considered. In such a case, the valve will comprise a flexible tubular section acted upon by a pinching mechanism coupled to activator rod 815.

What is claimed is:

1. A removable batch type diluent tank for use in connecting to a rigid gas coupling in a beverage dispenser comprising:

(a) a tank body for containing a supply of diluent having an opening therein;

(b) a removable cover for covering and sealing said opening;

(c) means for relieving pressure in said tank prior to removal of said cover;

(d) a quick disconnect coupling rigidly connected to said tank and adapted for sliding connection with the rigid gas coupling in said beverage dispenser, whereby said tank may be slid into said dispenser, for connecting a source of pressurizing gas to said tank; and (e) means for conducting diluent from said tank.

2. A tank according to claim 1 wherein said quick disconnect coupling comprises a coupling with two essentially parallel fittings adapted to mate with a complementary pair of essentially parallel fittings.

3. A tank according to claim 2 wherein said quick disconnect coupling comprises a block containing two parallel bores adapted to mate with fittings in the form of two parallel tubular stubs which may be inserted into said bores.

4. The tank according to claim 1 wherein said diluent comprises carbonated water and wherein said pressurizing gas comprises carbon dioxide gas and further including means in said diluent tank for carbonating water therein, said means coupled to one of said fittings in said coupling.

5. A tank according to claim 4 wherein said means for carbonating comprise: a diffuser block disposed near the bottom of said tank; a conduit extending between said diffuser block and said coupling to supply carbon dioxide thereto; and a restrictor to control the flow of carbon dioxide therethrough.

6. A tank according to claim 3 wherein said coupling is mounted on one side of said tank, said fittings thereby extending essentially in a radial direction and further including means on the other side of said tank for preventing movement of said tank after said quick disconnect connection is made.

7. A tank according to claim 6 wherein said tank is adapted to be supported on a horizontal supporting surface such that said coupling mates with said complementary fittings and wherein said means for preventing comprise a pin mounted to the opposite side of said tank from said coupling, and means for selectively inserting said pin into and removing said pin from a hole formed in the supporting surface.

8. A tank according to claim 7 wherein said means for inserting and removing comprise a collapsible handle mounted to said tank, said handle comprising: a U-shaped bracket vertically disposed on said tank on the side opposite said coupling having elongated slots in its sides near the bottom thereof; a first handle portion hinged to the top of said bracket; a second handle portion having one end hinged to said first handle portion and another end slidably coupled to said elongated slots at the bottom of said U-shaped bracket, said pin hinged to said other end of said second handle part, whereby movement of said handle to a collapsed position will result in a downward movement of said pin into a hole in said supporting means and extension of said handle will result in upward movement of the other end of said second handle part in said slot to remove said pin and provide a handle which can be grasped by a user to remove said tank from said fittings.

9. A tank according to claim 3 and further including check valves in the fittings of said coupling.

10. A tank according to claim 9 wherein the check valve in the water line comprises a valve core including a cylindrical stem portion of a first, smaller diameter; a conical section at the base of said stem section; and a partially cylindrical section, said cylindrical section having formed therein on each side thereof a pair of cuts of cylindrical cross-section, one of said pairs of cuts being directed inwardly and toward the bottom of said partially cylindrical portion, and the other pair being directed toward the top thereof and intersecting the base of said conical section to provide smooth flow passages; an o-ring for sealing against said conical section; a spring for biasing the conical section of said valve core against the O-ring; and means for retaining said O-ring, core and spring together with said spring biasing said core against said O-ring.

11. A tank according to claim 3 wherein said block is removable from said tank body.

12. A tank according to claim 11 wherein said block comprises a cylindrical flanged plastic block having a screw thread on its outer surface, said tank containing a flat portion having an opening through which said block can be inserted with its flange abutting against said flat portion on the outside of said tank, an O-ring inserted between the said flange and said tank body and a retaining ring screwed onto said threaded portion on the inside of said tank.

13. A tank according to claim 1, and further including mechanical means to prevent removal of said cover without venting of said tank.

14. A tank according to claim 13 wherein said tank body contains, in a recess in the opening in the top thereof, means for bringing and maintaining said cover in contact with said recess, and said mechanical means comprises a handle operable upon movement thereof to operate said means for relieving pressure, said handle extending radially beyond the circumference of said cover, and further including a cutout in the top of said tank body for accepting the portion of said handle which extends beyond said circumference when said cover is in place.

15. A tank according to claim 1 and further including a sealing gasket disposed between matching circumferential surfaces of said cover and said tank top thereby a seal will be effective irrespective of said cover being screwed down into said top to its full extent.

16. A batch type diluent tank for use in a beverage dispenser comprising:

(a) a tank body for containing a supply of diluent having an opening therein and having a recessed opening in the top thereof;
(b) a bore at the bottom of said recessed opening;
(c) a cover containing a cylindrical portion for covering and sealing said opening, said bore and cover including means for bringing them into and retaining them in sealing engagement;
(d) a means disposed in said cover for relieving pressure in said tank prior to removal of said cover;
(e) mechanical means to operate said means for relieving pressure;
(f) a cutout in the top of said tank body, said means to operate adapted to fit in said cutout such that said cover cannot be unscrewed until said means to operate is moved to relieve the pressure in said tank; and
(g) means for connecting a source of pressurizing gas to said tank and for conducting diluent from said tank.

17. A diluent tank according to claim 16 and further including:

(a) a shut-off valve for said source of pressurization; and
(b) means coupling said shut-off valve to said handle such that said handle cannot be rotated to relieve pressure unless said shut-off valve is closed.

18. A diluent tank according to claim 17 wherein said shut-off valve comprises a valve body with a plunger therein, an actuating rod extending therefrom and said means coupling includes said handle on said cover rotating between a position where it operates to move said plunger against said biasing spring to open said valve and a position where it is moved away from said plunger allowing said valve to close, said handle extending below a bracket in the top of the tank body when rotated to operate said plunger to open said valve whereby said handle is prevented from said lifted when in a position to open said valve.

19. A diluent tank for use in a beverage dispenser comprising:

(a) a tank body for containing a supply of diluent having a threaded opening therein;

(b) a threaded cover for covering said sealing said opening;

(c) means for relieving pressure in said tank prior to removal of said cover;

(d) means for connecting a source of pressurizing gas to said tank and for conducting diluent from said tank; and, (e) means for preventing said cover from being fully removed from said body upon removal of said cover by rotation until after, the seal between said cover and body is broken, whereby if said means for relieving pressure fails, gas can escape without having said cover blow off.

20. A removable batch type diluent tank for use in a beverage dispenser comprising:

(a) a tank body for containing a supply of diluent having an opening therein;

(b) a removable cover for covering and sealing said opening;

(c) means for relieving pressure in said tank prior to removal of said cover;

(d) mechanical interlock means for preventing removal of said cover until said means for relieving pressure are operated;

(c) a quick disconnect coupling for connecting a source of pressurizing gas to said tank; and (f) means for conducting diluent from said tank.

21. A tank according to claim 20, wherein said cover is removable by rotation and said tank body contains a recess therein and said mechanical interlock comprises movable means extending into said recess and coupled to said means to relieve pressure, movement of said means out of said recess to allow rotation of said cover operating said means to relieve pressure.

22. A tank according to claim 20, wherein said disconnect coupling is a sliding coupling.

23. A tank according to claim 20, wherein said means for relieving pressure is adapted to also act as an overpressure relief valve.

24. A removable batch type diluent tank for use in a beverage dispenser comprising:

(a) a tank body for containing a supply of diluent having an opening therein;

(b) a cover removable by rotation for covering and sealing said opening;

(c) means for supplying a pressurizing gas to said tank and means for removing diluent from said tank;

(d) means for relieving pressure in said tank prior to removal of said cover;

(e) mechanical interlock means for preventing removal of said cover until said means for relieving pressure are operated; and (f) means for preventing said cover from being fully removed from said body upon rotation of said cover until pressure within said tank is below a predetermined amount whereby, if said means for relieving pressure fails, gas can escape without having said cover blow off.

* * * * *